US009738846B2

(12) United States Patent
Yamamoto et al.

(10) Patent No.: US 9,738,846 B2
(45) Date of Patent: Aug. 22, 2017

(54) SOLID LUBRICANT AND SLIDING MEMBER HAVING SOLID LUBRICANT EMBEDDED THEREIN

(71) Applicant: OILES CORPORATION, Tokyo (JP)

(72) Inventors: Yoshiaki Yamamoto, Fujisawa (JP); Kentaro Okubo, Fujisawa (JP)

(73) Assignee: OILES CORPORATION, Tokyo (JP)

( * ) Notice: Subject to any disclaimer, the term of this patent is extended or adjusted under 35 U.S.C. 154(b) by 117 days.

(21) Appl. No.: 14/399,077

(22) PCT Filed: Apr. 10, 2013

(86) PCT No.: PCT/JP2013/060813
§ 371 (c)(1),
(2) Date: Nov. 5, 2014

(87) PCT Pub. No.: WO2013/168507
PCT Pub. Date: Nov. 14, 2013

(65) Prior Publication Data

US 2015/0133350 A1 May 14, 2015

(30) Foreign Application Priority Data

May 9, 2012 (JP) ..... 2012-107878

(51) Int. Cl.
*F16C 33/20* (2006.01)
*C10M 111/04* (2006.01)
*C10M 169/04* (2006.01)

(52) U.S. Cl.
CPC ..... *C10M 111/04* (2013.01); *C10M 169/04* (2013.01); *C10M 2201/062* (2013.01);
(Continued)

(58) Field of Classification Search
CPC ... C10M 5/00; C10M 107/04; C10M 101/025
(Continued)

(56) References Cited

U.S. PATENT DOCUMENTS

2005/0148701 A1* 7/2005 Harashina ..... C08K 5/5399 524/95
2010/0048433 A1* 2/2010 Yamamoto ..... C10M 133/42 508/100

FOREIGN PATENT DOCUMENTS

CN 101379171 3/2009
CN 101522874 9/2009
(Continued)

OTHER PUBLICATIONS

International Search Report for PCT/JP2013/060813 mailed Jul. 16, 2013.
(Continued)

*Primary Examiner* — Prem C Singh
*Assistant Examiner* — Francis C Campanell
(74) *Attorney, Agent, or Firm* — Nixon & Vanderhye P.C.

(57) ABSTRACT

Provided are: a solid lubricant having a low friction coefficient and excellent abrasion resistance; and a sliding member having this solid lubricant embedded therein. The solid lubricant (4) has a sea-island structure, comprising: a sea phase as a continuous phase, containing a hydrocarbon-based wax and a polyethylene resin; and an island phase as a dispersion phase, containing a low-molecular weight tetrafluoroethylene resin, a higher fatty acid salt, a phosphate of basic nitrogen-containing compound, and zinc stannate. A high-molecular weight tetrafluoroethylene resin is contained in this continuous-phase sea phase in a fibrous and mesh state. The hydrocarbon-based wax content is 30-60 vol %, the polyethylene resin content is 3-10 vol %, the low-molecular weight tetrafluoroethylene resin content is 10-30% vol %, the higher fatty acid salt content is 20-40% vol %, the basic nitrogen-containing compound phosphate content is 0.5-5 vol %, the zinc stannate content is 0.5-5 vol %, and the high-molecular weight tetrafluoroethylene resin content is 1-10 vol %.

32 Claims, 4 Drawing Sheets

(52) U.S. Cl.
CPC . *C10M 2205/022* (2013.01); *C10M 2205/143* (2013.01); *C10M 2205/163* (2013.01); *C10M 2205/22* (2013.01); *C10M 2207/126* (2013.01); *C10M 2213/062* (2013.01); *C10M 2213/0623* (2013.01); *C10M 2223/043* (2013.01); *C10N 2210/01* (2013.01); *C10N 2210/02* (2013.01); *C10N 2210/04* (2013.01); *C10N 2220/021* (2013.01); *C10N 2220/032* (2013.01); *C10N 2230/06* (2013.01); *C10N 2240/02* (2013.01); *C10N 2250/08* (2013.01); *C10N 2250/12* (2013.01); *C10N 2250/18* (2013.01)

(58) Field of Classification Search
USPC ..... 508/100, 591, 106
See application file for complete search history.

(56) References Cited

FOREIGN PATENT DOCUMENTS

| | | |
|---|---|---|
| EP | 1 586 623 | 10/2005 |
| EP | 1 637 579 | 3/2006 |
| EP | 2 060 620 | 5/2009 |
| JP | 52-76342 | 6/1977 |
| JP | 52-76574 | 6/1977 |
| JP | 55-108427 | 8/1980 |
| JP | 2004-339259 | 12/2004 |
| JP | 2005-179392 | 7/2005 |
| WO | WO 2004/101718 | 11/2004 |
| WO | WO 2005/014760 | 2/2005 |
| WO | WO 2008/029510 | 3/2008 |

OTHER PUBLICATIONS

Chinese Search Report issued in CN App. No. 201380024079.5 dated Jan. 19, 2016 (w/ translation).

Extended European Search Resort issued in EP App. No. 13788654.5 dated Oct. 7, 2015.

Zhang et al., "Preparation, Characterization and Tribological Behavior of Modified Nanoscale Zinc Hydroxystannate," *Lubrication Engineering*, Sep. 1, 2006, vol. 2006, No. 9 (w/ abstract).

Chinese Search Report issued in App. No. 201380024079.5 dated Sep. 23, 2016 (w/ translation).

Xianhui, "Practical Manual About Raw Materials and Equipment for the Production of Lubricating Grease", 1st Edition, Mar. 31, 2007, p. 97.

* cited by examiner

SOLID LUBRICANT AND SLIDING MEMBER HAVING SOLID LUBRICANT EMBEDDED THEREIN

This application is the U.S. national phase of International Application No. PCT/JP2013/060813 filed 10 Apr. 2013 which designated the U.S. and claims priority to Japanese Patent Application No. 2012-107878 filed 9 May 2012, the entire contents of each of which are hereby incorporated by reference.

TECHNICAL FIELD

The present invention relates to a solid lubricant to be embedded in holes or grooves formed in a sliding surface of a sliding member substrate of copper alloy or the like, and relates to a sliding member embedded with solid lubricant.

BACKGROUND ART

Solid lubricant, which is used for embedding in a sliding surface of a sliding member substrate of copper alloy or the like, gives a sliding effect by forming as solid lubricant film on the sliding surface. Thus, quality of the solid lubricant film largely affects friction coefficient, abrasion resistance, and film lifetime.

Among such type of solid lubricants, are solid lubricants having layered structure, particularly solid lubricants whose main component is graphite. Due to its layered structure, graphite shows high resistance in the load direction and shows low resistance in the sliding direction. Further graphite is soft, and has the property of being able to keep lubricating performance in a wide range of temperatures between ordinary temperature and a high temperature.

However, graphite-based solid lubricants are somewhat lacking in film-forming ability, and have inadequate film lifetime against repeated friction. Accordingly, graphite-based solid lubricants are restricted in conditions of use for sliding member, and are not suitable, for example, for use under high load.

As solid lubricants usable in high-load applications, can be mentioned solid lubricants composed of tetrafluoroethylene resin, soft metals such as indium, lead and tin, and wax. For example, there is a solid lubricant comprising tetrafluoroethylene resin, lead, polyolefin resin, and some kind of wax. This solid lubricant has a very low friction coefficient under high load condition, is superior in film-forming ability, and has long film lifetime and superior self-repairing property of film.

The solid lubricant comprising tetrafluoroethylene resin, lead, polyolefin resin, and some kind of wax provides superior sliding performance as described above. However, this solid lubricant is unfavorable since it contains lead, an environmental burden substance.

On the other hand, as a solid lubricant containing no lead as its constituent, there are known a solid lubricant (Patent Literature 1) formed of synthetic resin containing melamine-isocyanuric acid adduct, and a solid lubricant (Patent Literature 2) composed of polyethylene resin, hydrocarbon-based wax, and melamine cyanurate.

CITATION LIST

Patent Literature

Patent Literature 1: Japanese Unexamined Patent Application Laid-Open No. Sho55-108427

Patent Literature 2: Japanese Unexamined Patent Application Laid-Open No. 2004-339259

SUMMARY OF INVENTION

Technical Problem

However, when the solid lubricant described in Patent Literature 1, i.e. the solid lubricant formed of synthetic resin containing the melamine-isocyanuric acid adduct, is used for embedding in a sliding surface of a sliding member substrate of copper alloy or the like, the solid lubricant is poor in malleability as solid lubricant and inferior in ability to form lubrication film on the sliding surface, does not have sufficient sliding properties such as friction coefficient and abrasion resistance, and is far from good for use under high load. Further, when the solid lubricant described in Patent Literature 2, i.e. the solid lubricant composed of polyethylene resin, hydrocarbon-based wax, and melamine cyanurate, is used for embedding in a sliding surface of a sliding member substrate of copper alloy or the like, the solid lubricant does not have sufficient malleability as solid lubricant, is inferior in ability to form lubrication film on the sliding surface, and, for example, cannot be expected to slide via lubrication film to micro swinging movement of an opposite member (shaft). As a result, the solid lubricant has high friction coefficient and is inferior in abrasion resistance.

The present invention has been made considering the above situation. An object of the present invention is to provide solid lubricant that has superior malleability, and is superior in formation of lubrication film on sliding surface, and allows sliding via lubrication film for micro swinging movement of an opposite member, and has low friction coefficient, and is superior in abrasion resistance. Another object of the present invention is to provide a sliding member in which this solid lubricant is embedded.

Solution to Problem

The present invention provides a solid lubricant that has sea-island structure comprising a sea phase as a continuous phase and an island phase as a dispersion phase, wherein: the sea phase as the continuous phase contains a hydrocarbon-based wax and a polyethylene resin, and the island phase as the continuous phase contains a low-molecular-weight tetrafluoroethylene resin, a higher fatty acid salt, a phosphate of basic nitrogen-containing compound, and a zinc stannate; the high-molecular-weight tetrafluoroethylene resin is fiberized and contained in mesh state in the sea phase as the continuous phase; a content of the hydrocarbon-based wax is 30-60 volume %; a content of the polyethylene resin is 3-10 volume %; a content of the low-molecular-weight tetrafluoroethylene resin is 10-30 volume %; a content of the higher fatty acid salt is 20-40 volume %; a content of the phosphate of basic nitrogen-containing compound is 0.5-5 volume %; a content of the zinc stannate is 0.5-5 volume %; and a high-molecular-weight tetrafluoroethylene resin is 1-10 volume %.

Further, the present invention provides a sliding member, comprising: a sliding member substrate having a sliding surface in which a hole or a groove is formed; and the above-mentioned solid lubricant which is embedded in the hole or the groove.

Advantageous Effects of Invention

The present invention can provide a solid lubricant that has superior malleability and is superior in formability of lubrication film on a sliding surface. The solid lubricant of the present invention can realize sliding via lubrication film even for micro swinging movement of an opposite member, has a low friction coefficient and is superior in abrasion resistance. Further, the present invention provides a sliding member embedded with the mentioned solid lubricant.

DESCRIPTION OF EMBODIMENTS

Figure 1:
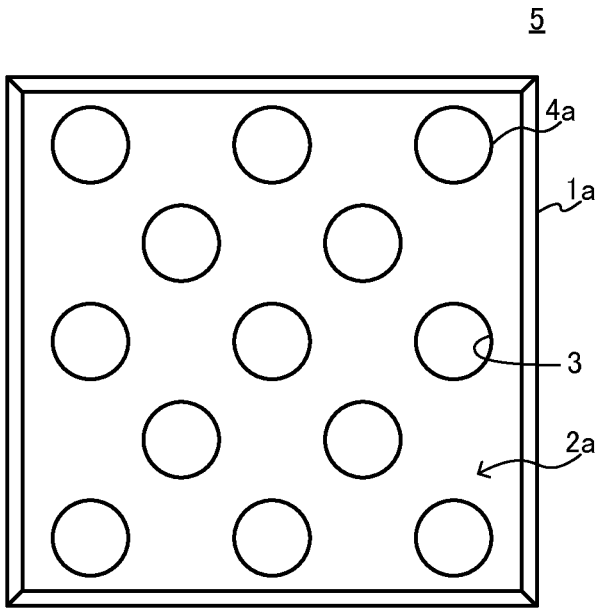
FIG. 1 is a plan view showing a thrust slide bearing in which solid lubricant according to one embodiment of the present invention is embedded.

In the following, one embodiment of the present invention will be described in detail. The present invention, however, is not limited to the embodiment described in the following, and can be variously changed within the scope of the invention.

A solid lubricant according to the present embodiment has sea-island structure comprising: a sea phase as a continuous phase, which contains a hydrocarbon-based wax and a polyethylene resin; and an island phase as a dispersion phase, which contains a low-molecular-weight tetrafluoroethylene resin, a higher fatty acid salt, a phosphate of basic nitrogen-containing compound, and a zinc stannate. Further, a high-molecular-weight tetrafluoroethylene resin is fiberized and contained in mesh state in the sea phase as the continuous phase. The hydrocarbon-based wax content is 30-60 volume %, the polyethylene resin content is 3-10 volume %, the low-molecular-weight tetrafluoroethylene resin content is 10-30 volume %, the higher fatty acid salt content is 20-40 volume %, the basic nitrogen-containing compound phosphate content is 0.5-5 volume %, the zinc stannate content is 0.5-5 volume %, and the high-molecular-weight tetrafluoroethylene resin content is 1-10 volume %.

The hydrocarbon-based wax, which forms the sea phase as continuous phase, mainly facilitates malleability of the solid lubricant in the sliding directions, and thus contributes to formation of lubrication film and gives low friction property. The hydrocarbon-based wax is selected format least one of a paraffin-based wax of carbon number 24 or more, an olefin-based wax of carbon number 26 or more, an alkyl benzene of carbon number 28 or more, and a microcrystalline wax.

The hydrocarbon-based wax content is 30-60 volume %, and preferably 35-50 volume %. When the hydrocarbon-based wax content is less than 30 volume %, malleability as solid lubricant is insufficient, so that it is difficult to form good lubrication film on a sliding surface of a sliding member substrate. When the hydrocarbon-based wax content exceeds 60 volume %, the strength of the solid lubricant decreases, and there is a possibility of worsening the moldability.

As specific examples of the hydrocarbon-based wax, can be mentioned a paraffin wax "150" made by Nippon Seiro Co., Ltd., a polyethylene wax "Licowax (trademark) PE520" made by Clariant (Japan) K.K., microcrystalline waxes "Hi-Mic (trademark)-1080", "Hi-Mic (trademark)-2045", "Hi-Mic (trademark)-2095" and "Luvax (trademark) 2191" made by Nippon Seiro Co., Ltd., and a mixture of polyethylene wax and paraffin wax, "Godeswax" made by Nikko Rica Corporation, and the like.

The polyethylene resin and the above-mentioned hydrocarbon-based wax are compatible with each other to form the sea phase as continuous phase, and only the hydrocarbon-based wax component is supplied excessively from the solid lubricant onto sliding surface. Thus the polyethylene resin serves as a binder for preventing deterioration of mechanical strength of the solid lubricant at the time of heating.

The polyethylene resin content is 3-10 volume %, and preferably 3-7 volume %. When the polyethylene resin content is less than 3 volume %, the polyethylene resin cannot sufficiently serve as the binder. When the polyethylene resin content exceeds 10 volume %, it is difficult to obtain good sliding properties.

As the polyethylene resin, can be used any of: low-density polyethylene resin (LDPE) of density 0.10-0.940 g/cm$^3$; linear low-density polyethylene resin (LLDPE) of density 0.910-0.940 g/cm$^3$; very low-density polyethylene resin (VLDPE) of density 0.880-0.910 g/cm$^3$; medium-density polyethylene resin (MDPE) of density 0.925-0.940 g/cm$^3$; high-density polyethylene resin (HDPE) of density 0.940-0.970 g/cm$^3$; high-molecular-weight polyethylene resin (HMWPE); ultrahigh molecular-weight polyethylene resin (UHMWPE) of density 0.930-0.940 g/cm$^3$ and molecular weight 1.5 million or more; and ethylene-vinyl acetate copolymer of density 0.920-0.950 g/cm$^3$.

As specific examples of the polyethylene resin, can be mentioned a high-density polyethylene resin "Hizex (trademark)", an ultrahigh molecular-weight polyethylene resin "Hizex Million (trademark)", and a high-molecular-weight polyethylene resin "Lubmer (trademark)" made by Mitsui Chemicals Inc., a low-density polyethylene resin "Flothene (trademark)" made by Sumitomo Seika Chemicals Co., Ltd., an ultrahigh molecular-weight polyethylene resin "Hostalen (trademark)" made by Hoechst AG., an ethylene-vinyl acetate copolymer "Evaflex (trademark)" made by Du Pont-Mitsui Polychemicals Co., Ltd., and the like. These polyethylene resins can be used each alone or as a mixture of two or more of them.

Compared with the sea phase as the continuous phase, the low-molecular-weight tetrafluoroethylene resin (hereinafter, shortly referred to as "low-molecular-weight PTFE") contained in the is land phase has a molecular weight of about 10,000-500,000, is easy to pulverize, and has good dispersibility, and in particular contributes to improvement of sliding properties such as improvement of abrasion resistance.

The low-molecular-weight PTFE content is 10-30 volume %, and preferably 10-20 volume %. When the low-molecular-weight PTFE content is less than 10 volume %, the low-molecular-weight does not contribute to reduction of the friction coefficient. And when the low-molecular-weight PTFE content exceeds 30 volume %, there is a possibility of reduction of strength as solid lubricant.

As specific examples of the low-molecular-weight PTFE, can be mentioned "TLP-10F-1" made by Du Pont-Mitsui Fluorochemicals Co., Ltd., "Lubron (trademark) L-5" made by Daikin Industries Ltd., "Fluon (trademark) L150J") and "Fluon (trademark) L169J" made by Asahi Glass Co., Ltd., and "KTL-8N" made by Kitamura Ltd., and the like.

The higher fatty acid salt (metallic soap) contained in the island phase as the dispersion phase is a salt of a saturated fatty acid of, generally, the carbon number 12 or more or an unsaturated fatty acid of, generally, the carbon number 12 or more and an alkali metal (an element of the group 1 in the periodic table) or alkali earth metal (an element of the group 2 in the periodic table). Examples of the saturated fatty acid of, generally, the carbon number 12 or more are lauric acid (C12), myristic acid (C14), palmitic acid (C16), stearic acid (C18), arachic acid (C20), behenic acid (C22), cerotic acid (C26), montanic acid (C28), melissic acid (C30) and the like. Examples of the unsaturated fatty acid of, generally, the carbon number 12 or more are lauroleic acid (C12), myristoleic acid (C14), oleic acid (C18), elaidic acid (C18), gadoleic acid (C20), erucic acid (C22), linoleic acid (C18), linoleric acid (C18), arachidonic acid (C20), and the like. As specific examples of the higher fatty acid salt, can be mentioned lithium stearate, calcium stearate, aluminum stearate, and the like.

The higher fatty acid salt contributes to reduction in the friction coefficient and improvement of the thermal stability. The higher fatty acid salt content is 20-40 volume %, and preferably 25-35 volume %. When the higher fatty acid salt content is less than 20 volume %, it does not sufficiently contribute to reduction in the friction coefficient and improvement of the thermal stability. On the other hand, when the higher fatty acid salt content exceeds 40 volume %, the strength of the solid lubricant decreases and there is a possibility of worsening the moldability.

The phosphate of basic nitrogen-containing compound contained in the island phase as the dispersion phase contributes to improvement of the abrasion resistance of the solid lubricant. The phosphate of basic nitrogen-containing compound is usually obtained by heat condensation reaction of a phosphoric acid source and a nitrogen source in the presence of a condensation agent, and then by baking the reaction product. The phosphoric acid source is ammonium orthophosphate, orthophosphoric acid, condensed phosphoric acid, anhydrous phosphoric acid, urea phosphate, phosphate—hydrogen ammonium or a mixture of these. The nitrogen source is melamine, dicyancyanamide, guanidine, guanylurea or a mixture of these. The condensation agent is urea, urea phosphate (this becomes also a phosphoric acid source) or a mixture of these. As preferable phosphate of basic nitrogen-containing compound, can be mentioned melamine polyphosphate salt, melam polyphosphate salt, melem polyphosphate salt, melamine polyphosphate-melam-melem double salt, or the like. In particular, melamine polyphosphate-melam-melem double salt is used preferably.

The phosphate of basic nitrogen-containing compound content is 0.5-5 volume %, and preferably 1-3 volume %. When the phosphate of basic nitrogen-containing compound content is less than 0.5 volume %, it cannot give sufficient abrasion resistance to the solid lubricant. Further, when the phosphate of basic nitrogen-containing compound content exceeds 5 volume %, there is, on the contrary, a possibility of worsening the abrasion resistance.

Similarly to the above-mentioned phosphate of basic nitrogen-containing compound, zinc stannate contained in the island phase as the dispersion phase contributes to improvement of the abrasion resistance of the solid lubricant. As the zinc stannate, can be mentioned zinc stannate (chemical name: zinc tin trioxide, formula: $ZnSnO_3$) and zinc hydroxystannate (chemical name: zinc tin hexahydroxide, formula: $ZnSn(OH)_6$). At least either one of these is used. The zinc stannate content is 0.5-5 volume %, and preferably 0.5-3 volume %. When the zinc stannate content is less than 0.5 volume %, it does not contribute to improvement of the abrasion resistance of the solid lubricant. On the other hand, when the zinc stannate content exceeds 5 volume %, there is, on the contrary, a possibility of worsening the abrasion resistance.

The high-molecular-weight tetrafluoroethylene resin (hereinafter, referred to as "high-molecular-weight PTFE"), which is finely fiberized and contained in the mesh state in the sea phase as the continuous phase comprising the hydrocarbon-based wax and the polyethylene resin, gives mainly low friction property to the solid lubricant and at the same time contributes to improvement of toughness of the solid lubricant. High-molecular-weight PTFE is used mainly for molding as molding powder or fine powder, and has a property of becoming fiberized by applying shear force. The high-molecular-weight PTFE is used in a form of unbaked powder or in a form of pulverized powder obtained by pulverizing after baking at a temperature higher than the melting point.

As specific examples of the high-molecular-weight PTFE, can be mentioned: "Teflon (trademark) 7-J", "Teflon (trademark) 7A-J", "Teflon (trademark) 6-J", and "Teflon (trademark) 6C-J", each made by Du Pont-Mitsui Fluorochemicals Co., Ltd.; "Polyflon (trademark) M-12", and "Polyflon (trademark) F-201", each made by Daikin Industries Ldt.; "Fluon (trademark) G163", "Fluon (trademark) G190", "Fluon (trademark) CD076", and "Fluon (trademark) CD090", each made by Asahi Glass Co., Ltd.; and "KT-300M" made by Kitamura Ltd. Further, other than these high-molecular-weight PTFE, it is possible to use PTFE modified with styrene-based polymer, acrylate-based polymer, methacrylate-based polymer, or acrylonitrile-based polymer. As a specific example, can be mentioned "Metablen (trademark) A-300" made by Mitsubishi Rayon Co., Ltd., for example.

The high-molecular-weight PTFE content is 1-10 volume %, and preferably 1-5 volume %. When the high-molecular-weight PTFE content is less than 1 volume %, low friction property and toughness cannot be sufficiently given to the solid lubricant. And when the high-molecular-weight PTFE content exceeds 10 volume %, there is a possibility of reducing the moldability.

The solid lubricant of the present embodiment is produced by compounding and mixing the above-mentioned ingredients (hydrocarbon-based wax, polyethylene resin, low-molecular-weight PTFE, higher fatty acid salt, phosphate of basic nitrogen-containing compound, zinc stannate, and high-molecular-weight PTFE) to get the respective contents in accordance with the above-mentioned volume percent, and then by molding the obtained mixture. Although the molding method is not limited to a specific method, the following method is employed preferably. That is to say, the mixture is supplied to an extruder, and is melted and kneaded at a temperature at which the hydrocarbon-based wax is melted. Then, the molded material of a string shape extruded from the extruder is cooled and cut to produce material in pellet form. This material is supplied to an injection molding machine, to mold at a temperature higher than the melting point of the polyethylene resin as the binder.

Next, a sliding member using the solid lubricant of the present embodiment will be described.

Figure 2:
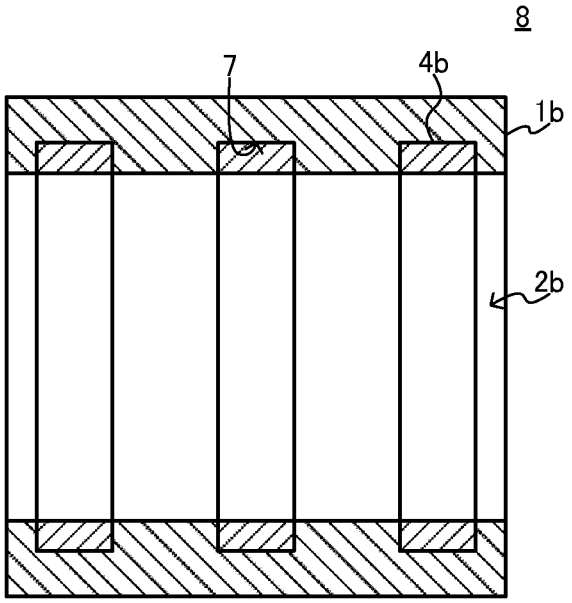
FIG. 2 is across-section view showing a journal slide bearing in which solid lubricant according to one embodiment of the present invention is embedded.

FIG. 1 is a plan view showing a thrust slide bearing in which the solid lubricant of the present embodiment is embedded; FIG. 2 is a cross-section view showing a journal slide bearing in which the solid lubricant of the present embodiment is embedded; and FIG. 3 is a cross-section view showing another form of journal slide bearing in which the solid lubricant of the present embodiment is embedded.

Figure 3:
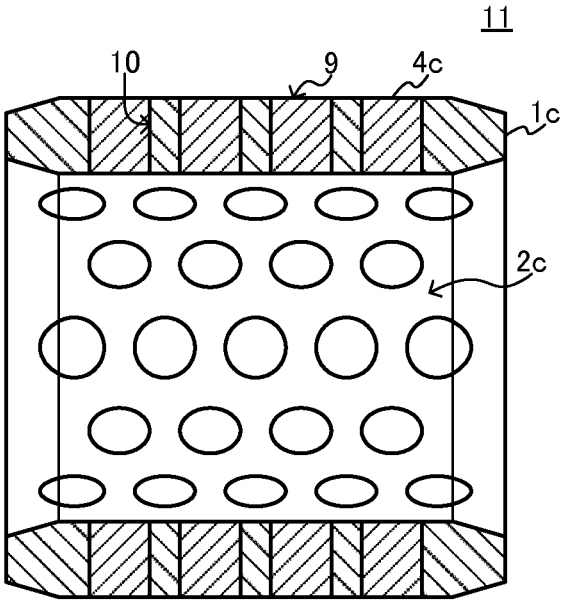
FIG. 3 is a cross-section showing another form of journal slide bearing in which solid lubricant according to one embodiment of the present invention is embedded.

As sliding members using the solid lubricant of the present embodiment, can be mentioned a thrust slide bearing 5 of the constitution as shown in FIG. 1, a journal slide bearing 8 of the constitution as shown in FIG. 2, and a journal slide bearing 11 of the constitution as shown in FIG. 3, for example. The thrust slide bearing 5 shown in FIG. 1 comprises: a sliding member substrate 1*a* of a square pillar shape made of metal material such as copper alloy or the like; and solid lubricant 4*a*, which fills a plurality of circular holes 3 formed to pass through from one surface (sliding surface) 2 of the sliding member substrate 1*a* in the width direction. The journal slide bearing 8 shown in FIG. 2 comprises: a cylindrical-shaped sliding member substrate 1*b* made of metal material such as copper alloy or the like; and solid lubricant 4*b*, which fills a plurality of ring—shaped grooves 7 arranged in the inner peripheral surface (sliding surface) 2*b* of the sliding member substrate 1*b* along the axial direction of the sliding member substrate 1*b*. The journal slide bearing 11 shown in FIG. 3 comprises: a cylindrical-shaped sliding member substrate 1*c* made of metal material such as copper alloy or the like; and solid lubricant 4*c*, which fills a plurality of circular holes 10 formed to pass through the inner peripheral surface (sliding surface) 2*c* and the outer peripheral surface 9 of the sliding member substrate 1*c*. Here, the solid lubricants 4*a*-4*c* are fixed to the circular holes 3 formed in the sliding surface 2*a* of the sliding member substrate 1*a*, the grooves 7 formed in the sliding surface 2*b* of the sliding member substrate 1*b*, and the circular holes 10 formed in the sliding surface 2*c* of the sliding member substrate 1*c*, respectively by using an adhesive for example.

Thrust slide bearing 5, the journal slide bearing 8 and the journal slide bearing 11 shown in FIGS. 1, 2 and 3 are formed so that the ratio of the total area of the opening space of the circular holes 3 to the area of the sliding surface 2*a* of the sliding member substrate 1*a*, the ratio of the opening space of the grooves 7 to the area of the sliding surface 2*b* of the sliding member substrate 1*b*, and the ratio of the opening space of the circular holes 10 to the area of the sliding surface 2*c* of the sliding member substrate 1*c* become 10-40%, and preferably 20-35%. The circular holes 3, 10 are formed by drilling work or cutting work using a drill, an end mill or the like. Further, the ring-shaped grooves 7 are formed by cutting work using a cutting tool or the like. These holes and grooves, however, may be formed by other means.

The solid lubricant of the present embodiment has superior malleability. Accordingly, when the sliding member, whose sliding surface is embedded with the solid lubricant of the present embodiment, on the opposite member (shaft) slide each other, a lubricant film of the solid lubricant is easily formed on the sliding surface. Thus, the sliding member and the opposite member slide via the lubrication film. And superior sliding properties are realized, for example, to micro swinging movement of an opposite member.

EXAMPLES

Now, examples according to the present invention will be described in detail. Of course, the present invention is not limited to the below-described examples, and various changes can be made within the scope of the invention.

Example 1

Into a Henschel mixer, were put about 45 volume % of Paraffin wax "150" made by Nippon Seiro Co., Ltd. as the hydrocarbon-based wax, about 5 volume % of low-density polyethylene resin "MA1003N" made by Sumitomo Seika Chemicals Co., Ltd. as the polyethylene resin, about 15 volume % of low-molecular-weight PTFE "KTL-8N" made by Kitamura Ltd., about 30 volume % of lithium stearate "S-7000" made by Sakai Chemical Industry Co., Ltd. as the higher fatty acid salt, about 2 volume % of melamine polyphosphate-melam-melem double salt "PHOSMEL-200" made by Nissan Chemical Industries, Ltd. as the phosphate of basic nitrogen-containing compound, about 1 volume % of zinc hydroxystannate "ALCANEX (trademark)-ZHS" made by Mizusawa Industrial Chemicals Ltd. as the zinc stannate, and about 2 volume % of high-molecular-weight PTFE "Fluon (trademark) G163" made by Asahi Glass Co., Ltd, to be mixed. The obtained mixture was supplied to an extruder, to be melted and kneaded at a temperature at which the hydrocarbon-based wax is melted. String-shaped molded material extruded from the extruder was cooled and cut to produce pellets. These pellets were supplied to an injection molding machine, and molded at a temperature at which the polyethylene resin in the ingredients is melted, so that column-shaped solid lubricants each having a diameter of 6 mm and a length of 5 mm were produced.

Example 2

Column-shaped solid lubricants each having a diameter of 6 mm and a length of 5 mm were produced in a similar manner to Example 1 by using about 40 volume % of "Godeswax", which is a mixture of polyethylene wax and paraffin wax, made by Nikko Rica Corporation as the hydrocarbon-based wax (as about 20 volume % of each of the polyethylene wax and the paraffin wax), about 5 volume % of linear low-density polyethylene resin "Flothene (trademark) F13142N" made by Sumitomo Seika Chemicals Co., Ltd. as the polyethylene resin, about 20 volume % of low-molecular-weight PTFE "KTL-8N" made by Kitamura Ltd., about 30 volume % of aluminum stearate as the higher fatty acid salt, about 2 volume % of melamine polyphosphate salt as the phosphate of basic nitrogen-containing compound, about 1 volume % of zinc hydroxystannate "ALCANEX (trademark)-ZHS" made by Mizusawa Industrial Chemicals Ltd., and about 2 volume % of high-molecular-weight PTFE "Fluon (trademark) G163" made by Asahi Glass Co., Ltd.

Example 3

Column-shaped solid lubricants each having a diameter of 6 mm and a length of 5 mm were produced in a similar manner to Example 1 by using about 30 volume % of "Godeswax", which is a mixture of polyethylene wax and paraffin wax, made by Nikko Rica Corporation (as about 15 volume % of each of the polyethylene wax and the paraffin wax) and about 10 volume % of microcrystalline wax "LUVAX (trademark) 2191" made by Nippon Seiro Co., Ltd. as the hydrocarbon-based waxes, about 5 volume % of high-density polyethylene resin "Hizex (trademark)" made by Mitsui Chemicals Inc. as the polyethylene resin, about 20 volume % of low-molecular-weight PTFE "KTL-8N" made by Kitamura Ltd., about 30 volume % of lithium stearate "S-7000" made by Sakai Chemical Industry Co., Ltd. as the higher fatty acid salt, about 2 volume % of melamine polyphosphate-melam-melem double salt "PHOSMEL-200" made by Nissan Chemical Industries, Ltd. as the phosphate of basic nitrogen-containing compound, about 1 volume % of zinc hydroxystannate "ALCANEX (trademark)-ZHS" made by Mizusawa Industrial Chemicals Ltd. as the zinc stannate, and about 2 volume % of high-molecular-weight PTFE "Fluon (trademark) G163" made by Asahi Glass Co., Ltd.

Example 4

Column-shaped solid lubricants each having a diameter of 6 mm and a length of 5 mm were produced in a similar manner to Example 1 by using about 20 volume % of "Godeswax", which is a mixture of polyethylene wax and paraffin wax, made by Nikko Rica Corporation (as about 10 volume % of each of the polyethylene wax and the paraffin wax) and about 10 volume % of microcrystalline wax "LUVAX (trademark) 2191" made by Nippon Seiro Co., Ltd. as the hydrocarbon-based waxes, about 5 volume % of low-density polyethylene resin "MA1003N" made by Sumitomo Seika Chemicals Co., Ltd. as the polyethylene resin, about 20 volume % of low-molecular-weight PTFE "KTL-8N" made by Kitamura Ltd., about 35 volume % of lithium stearate "S-7000" made by Sakai Chemical Industry Co., Ltd. as the higher fatty acid salt, about 2 volume % of melamine polyphosphate-melam-melem double salt "PHOSMEL-200" made by Nissan Chemical Industries, Ltd. as the phosphate of basic nitrogen-containing compound, about 1 volume % of zinc hydroxystannate "ALCANEX (trademark)-ZHS" made by Mizusawa Industrial Chemicals Ltd. as the zinc stannate, and about 2 volume % of high-molecular-weight PTFE "Fluon (trademark) G163" made by Asahi Glass Co., Ltd.

Example 5

Column-shaped solid lubricants each having a diameter of 6 mm and a length of 5 mm were produced in a similar manner to Example 1 by using about 30 volume % of "Godeswax", which is a mixture of polyethylene wax and paraffin wax, made by Nikko Rica Corporation (as about 15 volume % of each of the polyethylene wax and the paraffin wax) and about 10 volume % of microcrystalline wax "LUVAX (trademark) 2191" made by Nippon Seiro Co., Ltd. as the hydrocarbon-based waxes, about 5 volume % of ultrahigh molecular-weight polyethylene resin "Hizex Million (trademark)" made by Mitsui Chemicals Inc. as the polyethylene resin, about 20 volume % of low-molecular-weight PTFE "KTL-8N" made by Kitamura Ltd., about 30 volume % of lithium stearate "S-7000" made by Sakai Chemical Industry Co., Ltd. as the higher fatty acid salt, about 2 volume % of melamine polyphosphate-melam-melem double salt "PHOSMEL-200" made by Nissan Chemical Industries, Ltd. as the phosphate of basic nitrogen-containing compound, about 1 volume % of zinc hydroxystannate "ALCANEX (trademark)-ZHS" made by Mizusawa Industrial Chemicals Ltd. as the zinc stannate, and 2 volume % of high-molecular-weight PTFE "Fluon (trademark) G163" made by Asahi Glass Co., Ltd.

Example 6

Column-shaped solid lubricants each having a diameter of 6 mm and a length of 5 mm were produced in a similar manner to Example 1 by using about 35 volume % of "Godeswax", which is a mixture of polyethylene wax and paraffin wax, made by Nikko Rica Corporation (as about 17.5 volume % of each of the polyethylene wax and the paraffin wax) and about 10 volume % of microcrystalline wax "LUVAX (trademark) 2191" made by Nippon Seiro Co., Ltd. as the hydrocarbon-based waxes, about 5 volume % of low-density polyethylene resin "MA1003N" made by Sumitomo Seika Chemicals Co., Ltd. as the polyethylene resin, about 15 volume % of low-molecular-weight PTFE "KTL-8N" made by Kitamura Ltd., about 30 volume % of lithium stearate "S-7000" made by Sakai Chemical Industry Co., Ltd. as the higher fatty acid salt, about 2 volume % of melamine polyphosphate-melam-melem double salt "PHOSMEL-200" made by Nissan Chemical Industries, Ltd. as the phosphate of basic nitrogen-containing compound, about 1 volume % of zinc hydroxystannate "ALCANEX (trademark)-ZHS" made by Mitsuzawa Industrial Chemicals Ltd. as the zinc stannate, and about 2 volume % of high-molecular-weight PTFE "Fluon (trademark) G163" made by Asahi Glass Co., Ltd.

Example 7

Column-shaped solid lubricants each having a diameter of 6 mm and a length of 5 mm were produced in a similar manner to Example 1 by using about 40 volume % of "Godeswax", which is a mixture of polyethylene wax and paraffin wax, made by Nikko Rica Corporation (as about 20 volume % of each of the polyethylene wax and the paraffin wax) and about 10 volume % of microcrystalline wax "LUVAX (trademark) 2191" made by Nippon Seiro Co., Ltd. as the hydrocarbon-based waxes, about 5 volume % of low-density polyethylene resin "MA1003N" made by Sumitomo Seika Chemicals Co., Ltd. as the polyethylene resin, about 15 volume % of low-molecular-weight PTFE "KTL-8N" made by Kitamura Ltd., about 35 volume % lithium stearate "S-7000" made by Sakai Chemical Industry Co., Ltd. as the higher fatty acid salt, about 2 volume % of melamine polyphosphate-melam-melem double salt "PHOSMEL-200" made by Nissan Chemical Industries, Ltd. as the phosphate of basic nitrogen-containing compound, about 1 volume % of zinc hydroxystannate "ALCANEX (trademark)-ZHS" made by Mitsuzawa Industrial Chemicals Ltd. as the zinc stannate, and about 2 volume % of high-molecular-weight PTFE "Fluon (trademark) G163" made by Asahi Glass Co., Ltd.

Comparative Example 1

Into a Henschel mixer, were put about 50 volume % of linear low-density polyethylene resin "Flothene (trademark) F13142N" made by Sumitomo Seika Chemicals Co., Ltd. as a polyethylene resin, and about 50 volume % of melamine cyanurate, to be mixed. The obtained mixture was supplied to an extruder, to be melted and kneaded. Then, string-shaped molded material extruded from the extruder was cooled and cut, to produce pellets. Then, these pellets were supplied to an injection molding machine, and molded to produce column-shaped solid lubricant each having a diameter of 6 mm and a length of 5 mm.

Comparative Example 2

Column-shaped solid lubricants each having a diameter of 6 mm and a length of 5 mm were produced in a similar manner to Comparative Example 1 by using about 13 volume % of Paraffin wax "150" made by Nippon Seiro Co., Ltd as a hydrocarbon-based wax, about 10 volume % of low-density polyethylene resin "MA1003N" made by Sumitomo Seika Chemicals Co., Ltd. as a polyethylene resin, about 30 volume % of low-molecular-weight PTFE "KTL- 8N" made by Kitamura Ltd., about 7 volume % of lithium stearate "S-7000" made by Sakai Chemical Industry Co., Ltd. as a higher fatty acid salt, and about 40 volume % of lead.

Comparative Example 3

Column-shaped solid lubricants each having a diameter 6 mm and a length 5 mm were produced in a similar manner to Example 1 by using about 28 volume % of "Godeswax", which is a mixture of polyethylene wax and paraffin wax, made by Nikko Rica Corporation as a hydrocarbon-based wax (as about 14 volume % of each of the polyethylene wax and the paraffin wax), about 13 volume % of high-density polyethylene resin "Hizex (trademark)" made by Mitsui Chemicals Inc. as a polyethylene resin, about 33 volume % of melamine cyanurate, about 15 volume % of stearic acid as a higher fatty acid, and about 11 volume % of high-molecular-weight PTFE "Fluon (trademark) G163" made by Asahi Glass Co., Ltd.

With respect to each kind of the column-shaped solid lubricant obtained by the above-described Examples 1-7 and Comparative Examples 1-3, a thrust slide bearing test piece 12 was made by embedding the column-shaped solid lubricants in question in circular holes formed in a sliding member substrate of a flat plate shape made of copper alloy. Then thrust test was carried out for each slide bearing test piece 12, to measure the friction coefficient and the depth of wear.

<Method of Thrust Test>

Figure 4:
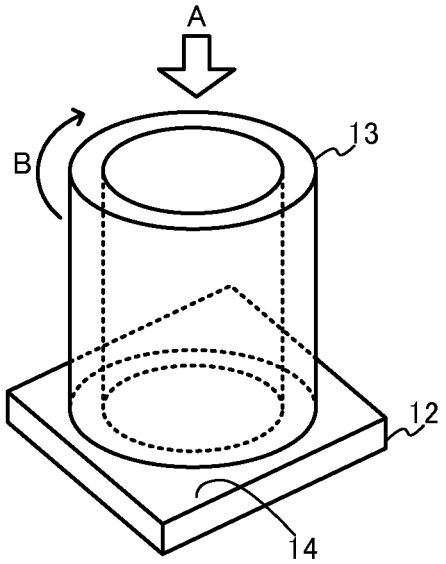
FIG. 4 is a perspective view for explaining a method of thrust test.

FIG. 4 is a perspective view for explaining a method of the thrust test. As shown in the figure, in the thrust test method, each of the thrust slide bearing test pieces 12 obtained in the above-described Examples 1-7 and Comparative Examples 1-3 is fixed, and a cylindrical body 13 made of metal as an opposite member is rotated in the arrow direction B, while applying a prescribed load A on the cylindrical body 13 in the direction toward a sliding surface (upper surface) 14 from above the thrust slide bearing test piece 12, to measure the friction coefficient between the thrust slide bearing test piece 12 and the cylindrical body 13 and the depth of wear of the thrust slide bearing test piece 12.

Test conditions of the thrust test are shown in Table 1.

TABLE 1

| | |
|---|---|
| Material of thrust slide bearing test piece 12 | High strength brass casting (Class 4) (rectangular test piece of 35 mm on a side and depth of 5 mm) |
| Material of opposite member (Cylindrical body 13) | Stainless steel (SUS403) |

TABLE 1-continued

| | |
|---|---|
| Ratio of exposed area of solid lubricants to area of sliding surface 14 | 30% (13 pieces of solid lubricants were embedded) |
| Slipping velocity | 1 m/min |
| Load | 29.4 Mpa (surface pressure: 300 kgf/cm$^2$) |
| Lubrication | Initial application of grease on sliding surface 14 |
| Test time | 16 hours |

Under these test conditions, the friction coefficient and the depth of wear were measured at a point when 8 hours of test time elapsed and at the end of the 16 hour test time. The test results are shown in Tables 2-4.

TABLE 2

| | | | Example 1 | 2 | 3 |
|---|---|---|---|---|---|
| Component composition (volume %) | <Hydrocarbon-based wax> | | | | |
| | Paraffin wax | | 45 | 20 | 15 |
| | Polyethylene wax | | — | 20 | 15 |
| | Microcrystalline wax | | — | — | 10 |
| | <Polyethylene resin> | | | | |
| | LDPE | | 5 | — | — |
| | LLDPE | | — | 5 | — |
| | HDPE | | — | — | 5 |
| | UHMWPE | | — | — | — |
| | <Low-molecular-weight PTFE> | | 15 | 20 | 20 |
| | <Higher fatty acid salt> | | | | |
| | Lithium stearate | | 30 | — | 30 |
| | Aluminum stearate | | — | 30 | — |
| | <Phosphate of basic nitrogen-containing compound> | | | | |
| | Melamine polyphosphate-melam-melem | | 2 | — | 2 |
| | Melamine polyphosphate salt | | — | 2 | — |
| | <Zinc stannate> | | | | |
| | Zinc hydroxystannate | | 1 | 1 | 1 |
| | <High-molecular-weight PTFE> | | 2 | 2 | 2 |
| Test results | 8 hours | Friction coefficient | 0.10 | 0.10 | 0.09 |
| | | Depth of wear (μm) | 4 | 5 | 4 |
| | 16 hours | Friction coefficient | 0.10 | 0.09 | 0.08 |
| | | Depth of wear (μm) | 6 | 6 | 5 |

TABLE 3

| | | Example 4 | 5 | 6 | 7 |
|---|---|---|---|---|---|
| Component (volume %) composition | <Hydrocarbon-based wax> | | | | |
| | Paraffin wax | 10 | 15 | 17.5 | 20 |
| | Polyethylene wax | 10 | 15 | 17.5 | 20 |
| | Microcrystalline wax | 10 | 10 | 10 | 10 |
| | <Polyethylene resin> | | | | |
| | LDPE | 5 | — | 5 | 5 |
| | LLDPE | — | — | — | — |
| | HDPE | — | — | — | — |
| | UHMWPE | — | 5 | — | — |
| | <Low-molecular-weight PTFE> | 25 | 20 | 15 | 15 |

TABLE 3-continued

| | | | Example 4 | 5 | 6 | 7 |
|---|---|---|---|---|---|---|
| | <Higher fatty acid salt> | | | | | |
| | Lithium stearate | | 35 | 30 | 30 | 35 |
| | Aluminum stearate | | — | — | — | — |
| | <Phosphate of basic nitrogen-containing compound> | | | | | |
| | Melamine polyphosphate-melam-melem | | 2 | 2 | 2 | 2 |
| | Melamine polyphosphate salt | | — | — | — | — |
| | <Zinc stannate> | | | | | |
| | Zinc hydroxystannate | | 1 | 1 | 1 | 1 |
| | <High-molecular-weight PTFE> | | 2 | 2 | 2 | 2 |
| Test results | 8 hours | Friction coefficient | 0.09 | 0.09 | 0.08 | 0.09 |
| | | Depth of wear (μm) | 4 | 4 | 3 | 4 |
| | 16 hours | Friction coefficient | 0.09 | 0.09 | 0.08 | 0.09 |
| | | Depth of wear (μm) | 5 | 5 | 4 | 5 |

TABLE 4

| | | | Comparative example 1 | 2 | 3 |
|---|---|---|---|---|---|
| Component composition (volume %) | <Hydrocarbon-based wax> | | | | |
| | Paraffin wax | | — | 13 | 14 |
| | Polyethylene wax | | — | — | 14 |
| | Microcrystalline wax | | — | — | — |
| | <Polyethylene resin> | | | | |
| | LDPE | | — | 10 | — |
| | LLDPE | | 50 | — | — |
| | HDPE | | — | — | 13 |
| | UHMWPE | | — | — | — |
| | <Melamine cyanurate> | | 50 | — | 33 |
| | <Low-molecular-weight PTFE> | | — | 30 | — |
| | <Higher fatty acid salt> | | | | |
| | Lithium stearate | | — | 7 | — |
| | Aluminum stearate | | — | — | — |
| | <Higher fatty acid> | | | | |
| | Stearic acid | | — | — | 15 |
| | <High-molecular-weight PTFE> | | — | — | 11 |
| | <Lead> | | — | 40 | — |
| Test results | 8 hours | Friction coefficient | >0.2 | 0.10 | 0.10 |
| | | Depth of wear (μm) | * | 9 | 7 |
| | 16 hours | Friction coefficient | — | 0.12 | 0.15 |
| | | Depth of wear (μm) | — | 18 | 20 |

In the Table 4, the mark "*" means that the friction coefficient exceeded 0.2 in the course of the thrust test, so that the test was stopped.

As shown in Tables 2-4, the thrust slide bearing test pieces 12 whose sliding surfaces 14 were embedded with the solid lubricants according to Examples 1-7 showed the low friction properties from the initial stages of sliding, and also their depths of wear were very small. On the other hand, the thrust slide bearing test pieces 12 whose sliding surfaces 14 were embedded with the solid lubricants according to Comparative Examples 2 and 3 showed comparable performances at the point when 8 hours of the test time elapsed with those of the thrust slide bearing test pieces 12 whose sliding surfaces 14 were embedded with the solid lubricants according to Examples 1-7 of the present invention. However, with the test time progress, the friction coefficients rose, and showed large values at the end of the test time. Further, in the case of Comparative Example 1, the friction coefficient exceeded 0.2 in the course of the test, and therefore the test was stopped.

In the cases of the thrust slide bearing test pieces 12 embedded with the solid lubricants according to Examples 1-7 of the present invention, it was observed that solid lubricant film was formed in the periphery of exposed surface of each solid lubricant. It is inferred that this was caused by the superior malleability. Thus, it is considered that the superior sliding properties showed by the thrust slide bearing test pieces 12 embedded with the solid lubricants according to Examples 1-7 of the present invention were each caused by transition, in the early part of sliding, to sliding via solid lubricant film formed in the sliding surface 14.

As described hereinabove, the solid lubricant according to the present invention has superior malleability and is superior in formation of lubrication film on sliding surface. Accordingly, in a sliding member embedded with the solid lubricant of the present invention, lubrication film is easily formed on the sliding surface, and sliding via the lubrication film is performed even for micro swinging movement of an opposite member. Thus, the present invention can provide a solid lubricant having low friction coefficient and superior abrasion resistance, and a sliding member embedded with the solid lubricant.

INDUSTRIAL APPLICABILITY

The present invention can be applied to various sliding members such as thrust slide bearings, journal slide bearings, and the like.

REFERENCE SIGNS LIST

1*a*-1*c*: sliding member substrate; 2*a*-2*c*: sliding surface; 3: circular hole; 4*a*-4*c*: solid lubricant; 5: thrust slide bearing;

7: groove; 8: journal slide bearing: 9: outer peripheral surface; 10: circular hole; and 11: journal slide bearing.

The invention claimed is:

1. A solid lubricant that has sea-island structure comprising a sea phase as a continuous phase and an island phase as a dispersion phase, wherein:

the sea phase as the continuous phase contains a first tetrafluoroethylene resin, a hydrocarbon-based wax, and a polyethylene resin, and the island phase as the continuous phase contains a second tetrafluoroethylene resin whose molecular-weight is lower than the first tetrafluoroethylene resin, a higher fatty acid salt, a phosphate of basic nitrogen-containing compound, and a zinc stannate;

the first tetrafluoroethylene resin is fiberized and contained in mesh state in the sea phase as the continuous phase;

the content of the hydrocarbon-based wax is 30-60 volume %;

the content of the polyethylene resin is 3-10 volume %;

the content of the low-molecular-weight tetrafluoroethylene resin is 10-30 volume %;

the content of the higher fatty acid salt is 20-40 volume %;

the content of the phosphate of basic nitrogen-containing compound is 0.5-5 volume %;

the content of the zinc stannate is 0.5-5 volume %; and the content of the first tetrafluoroethylene resin is 1-10 volume %.

2. A solid lubricant according to claim 1, wherein:

the hydrocarbon-based wax is at least one selected from a paraffin-based wax of carbon number 24 or more, an olefin-based wax of carbon number 26 or more, an alkyl benzene of carbon number 28 or more, and a microcrystalline wax.

3. A solid lubricant according to claim 1, wherein:

the polyethylene resin is at least one selected from polyethylene resins having different densities, polyethylene resins having different molecular-weights, and ethylene-vinyl acetate copolymer.

4. A solid lubricant according to claim 1, wherein:

the phosphate of basic nitrogen-containing compound is at least one selected from melamine polyphosphate salt, melam polyphosphate salt, melem polyphosphate salt, melamine phosphate-melam-melem double salt.

5. A solid lubricant according to claim 1, wherein:

the zinc stannate is at least one selected from zinc tin trioxide and zinc tin hexahydroxide (zinc hydroxystannate).

6. A sliding member, comprising:

a sliding member substrate having a sliding surface in which a hole or a groove is formed; and solid lubricant according to claim 1 is embedded in the hole or the groove.

7. A solid lubricant according to claim 2, wherein:

the polyethylene resin is at least one selected from resin polyethylene resins having different densities, polyethylene resins having different molecular-weights, and ethylene-vinyl acetate copolymer.

8. A solid lubricant according to claim 2, wherein:

the phosphate of basic nitrogen-containing compound is at least one selected from melamine polyphosphate salt, melam polyphosphate salt, melem polyphosphate salt, melamine phosphate-melam-melem double salt.

9. A solid lubricant according to claim 3, wherein:

the phosphate of basic nitrogen-containing compound is at least one selected from melamine polyphosphate salt, melam polyphosphate salt, melem polyphosphate salt, melamine phosphate-melam-melem double salt.

10. A solid lubricant according to claim 7, wherein:

the phosphate of basic nitrogen-containing compound is at least one selected from melamine polyphosphate salt, melam polyphosphate salt, melem polyphosphate salt, melamine phosphate-melam-melem double salt.

11. A solid lubricant according to claim 2, wherein:

the zinc stannate is at least one selected from zinc tin trioxide and zinc tin hexahydroxide (zinc hydroxystannate).

12. A solid lubricant according to claim 3, wherein:

the zinc stannate is at least one selected from zinc tin trioxide and zinc tin hexahydroxide (zinc hydroxystannate).

13. A solid lubricant according to claim 7, wherein:

the zinc stannate is at least one selected from zinc tin trioxide and zinc tin hexahydroxide (zinc hydroxystannate).

14. A solid lubricant according to claim 4, wherein:

the zinc stannate is at least one selected from zinc tin trioxide and zinc tin hexahydroxide (zinc hydroxystannate).

15. A solid lubricant according to claim 8, wherein:

the zinc stannate is at least one selected from zinc tin trioxide and zinc tin hexahydroxide (zinc hydroxystannate).

16. A solid lubricant according to claim 9, wherein:

the zinc stannate is at least one selected from zinc tin trioxide and zinc tin hexahydroxide (zinc hydroxystannate).

17. A solid lubricant according to claim 10, wherein:

the zinc stannate is at least one selected from zinc tin trioxide and zinc tin hexahydroxide (zinc hydroxystannate).

18. A sliding member, comprising:

a sliding member substrate having a sliding surface in which a hole or a groove is formed; and solid lubricant according to claim 2 is embedded in the hole or the groove.

19. A sliding member, comprising:

a sliding member substrate having a sliding surface in which a hole or a groove is formed; and solid lubricant according to claim 3 is embedded in the hole or the groove.

20. A sliding member, comprising:

a sliding member substrate having a sliding surface in which a hole or a groove is formed; and solid lubricant according to claim 7 is embedded in the hole or the groove.

21. A sliding member, comprising:

a sliding member substrate having a sliding surface in which a hole or a groove is formed; and solid lubricant according to claim 4 is embedded in the hole or the groove.

22. A sliding member, comprising:

a sliding member substrate having a sliding surface in which a hole or a groove is formed; and solid lubricant according to claim 8 is embedded in the hole or the groove.

23. A sliding member, comprising:

a sliding member substrate having a sliding surface in which a hole or a groove is formed; and solid lubricant according to claim 9 is embedded in the hole or the groove.

24. A sliding member, comprising:

a sliding member substrate having a sliding surface in which a hole or a groove is formed; and solid lubricant according to claim 10 is embedded in the hole or the groove.

25. A sliding member, comprising:

a sliding member substrate having a sliding surface in which a hole or a groove is formed; and solid lubricant according to claim 5 is embedded in the hole or the groove.

26. A sliding member, comprising:

a sliding member substrate having a sliding surface in which a hole or a groove is formed; and solid lubricant according to claim 11 is embedded in the hole or the groove.

27. A sliding member, comprising:

a sliding member substrate having a sliding surface in which a hole or a groove is formed; and solid lubricant according to claim 12 is embedded in the hole or the groove.

28. A sliding member, comprising:

a sliding member substrate having a sliding surface in which a hole or a groove is formed; and solid lubricant according to claim 13 is embedded in the hole or the groove.

29. A sliding member, comprising:

a sliding member substrate having a sliding surface in which a hole or a groove is formed; and solid lubricant according to claim 14 is embedded in the hole or the groove.

30. A sliding member, comprising:

a sliding member substrate having a sliding surface in which a hole or a groove is formed; and solid lubricant according to claim 15 is embedded in the hole or the groove.

31. A sliding member, comprising:

a sliding member substrate having a sliding surface in which a hole or a groove is formed; and solid lubricant according to claim 16 is embedded in the hole or the groove.

32. A sliding member, comprising:

a sliding member substrate having a sliding surface in which a hole or a groove is formed; and solid lubricant according to claim 17 is embedded in the hole or the groove.

* * * * *